United States Patent [19]

Takano et al.

[11] 3,931,492

[45] Jan. 6, 1976

[54] THERMAL PRINT HEAD

[75] Inventors: Rikuo Takano, Musashino; Mitsushi Matsunaga, Tokorozawa; Akira Yoshida, Tokyo; Kiyoshi Nawata, Kawasaki; Shigehisa Nakaya, Kodaira, all of Japan

[73] Assignee: Nippon Telegraph and Telephone Public Corporation, Tokyo, Japan

[22] Filed: June 7, 1973

[21] Appl. No.: 367,705

[30] Foreign Application Priority Data

June 19, 1972 Japan ..... 47-60488
Jan. 12, 1973 Japan ..... 48-5992

[52] U.S. Cl. ..... 219/216; 219/543; 357/15
[51] Int. Cl.[2] ..... H05B 3/12
[58] Field of Search ..... 219/216, 543; 357/28, 15; 346/76 R

[56] References Cited

UNITED STATES PATENTS

| | | | |
|---|---|---|---|
| 3,515,850 | 6/1970 | Cady, Jr. | 219/543 X |
| 3,642,528 | 2/1972 | Kimera | 357/15 |
| 3,719,797 | 3/1973 | Andrews et al. | 357/28 X |
| 3,774,170 | 11/1973 | Koch | 357/15 |
| 3,781,825 | 12/1973 | Burker et al. | 357/15 |

OTHER PUBLICATIONS

S. M. Krakauer et al., Hot Carrier Diodes Switch in Picoseconds, 7–19–63, pages 53–55.

*Primary Examiner*—G. Harris
*Attorney, Agent, or Firm*—Charles E. Pfund, Esq.

[57] ABSTRACT

The thermal print head comprises a substrate, a semiconductor wafer fabricated thereover, a plurality of junctions formed on the semiconductor wafer, and electrodes to supply an inverse current to the junctions. The junctions are arranged so as to correspond to the pattern of the symbol, such as letters, to be printed. Each of the junctions is used as a heating element. Heat is evolved at the junction when the inverse current flows through the potential barrier which is formed at the junction. The heat evolved is used for the heating element.

16 Claims, 17 Drawing Figures

THERMAL PRINT HEAD

FIELD OF THE INVENTION

The present invention relates to a thermal print head, and more particularly to a novel thermal print head using a junction having a potential barrier as a heating element.

Non-impact printers do not use mechanical impact so that low noise and high speed may be readily attained in the printing operation. For this reason, it has been recognized that the non-impact printer is useful in calculation in the scientific field and in information retrieval.

The thermal printer is a kind of non-impact printer in which a matrix of heating elements of the print head has the elements selectively energised corresponding to the information to be printed to heat a thermosensitive paper, the print head being physically in contact with the thermosensitive paper when the printing is carried out. The thermal printer is the dry-type and has no need of developing steps in the printing process, and provides ease in handling, Those advantages of this printer has attracted a significant attention.

The thermal print head according to this invention is used in a thermal printer. Joule heat has been used for the heat source of the thermal print head of the prior art provided an ohmic resistor on a high resistance substrate such as glass with current flowing through the resistor for generating heat.

For example, there has been used for such ohmic resistor, a thin film resistor such as a tantalum nitride film, a nichrome film or a tin oxide film, a thick film resistor such as a cement film of combined glass with silver or palladium formed by silk-screening, a thin film cermet resistor such as cermet film composed of silicon monoxide and chromium formed by the sputtering technique, or a resistor which is diffused on a semiconductor slab with mesa structure such as N-type silicon diffused resistor. The ohmic resistors for generating heat are arranged in matrix on a wafer to form any pattern to be printed. In this arrangement, the mesa structure is often employed for the resistor to enhance thermal isolation among those heat generating resistors.

Thus, the thermal print head of the prior art has disadvantages as follows: It is necessary for each heating element or printing element to operate surely and uniformly in order to obtain a high quality print. As a result, it requires fabrication of each resistor heating element with the same resistance value of high accuracy. However, it is difficult to control the three dimensional configuration, particularly the thickness of the resistor. This is an obstacle to enhancement of the printing quality and to adaptation of the mass production thereof. Another disadvantage lies in the reliability and the lifetime of the heating element due to the fact that since ohmic contact is required between the resistor and lead wires connected thereto, the contact portion is subject to high temperature at all times, and it also is difficult to obtain an ideal and uniform interconnection therebetween thereby resulting in current concentration. The need to make current flow through the heating element in the surface direction thereof, particularly in the tangential direction, restricts the configuration of the resistor to rectangular alone. As a result, the printing quality is poor, particularly in printing a skewed line. Since the heating element resistor has no non-linearity characteristic, diodes components are required in forming the driving circuit of the matrix type, otherwise only low speed operation is permitted in the driving of the resistor. Particularly in the semiconductor diffused resistor the heating element resistor has large heat capacity in itself thereby resulting in poor efficiency of heat response. For this reason, a large electric power is necessary to obtain a proper temperature suitable for printing and a large sized heat radiating plate or cold plate is required to cool it; In addition, high speed printing operation is impossible since it has inherently a poor thermal response due to the heating and cooling time lag caused by the heat capacity thereof. When it is fabricated in the mesa structure, it is fragile mechanically, and the fabricating process thereof is complex. The thermal print head of the prior art has further disadvantage in that the resistor must be, to ensure the reliability thereof, restricted to one hundred and several tens ohms in the sheet resistivity. Accordingly, in order to obtain energy enough for the desired printing, large current is required so that a relatively great power is lost in lead wires.

SUMMARY OF THE INVENTION

Thus, it will be understood that among the objects of this invention are the following:

To provide a thermal print head of a simple structure, of good heat efficiency, and of good thermal response, and further being operable with relatively small power;

To provide a thermal print head suitable for mass production thereof with good reliability and printing quality;

To provide a thermal print head capable of constructing a diode-matrix circuit for actuating the heating elements without using excess diodes.

To provide a thermal print head having good thermal isolation among the heating elements thereof;

To provide a thermal print head which is easy to fabricate and has excellent reliability.

In accordance with this invention, there is provided a thermal print head consisting of heating elements, each of which is a non-linear junction having potential barrier.

The junction having potential barrier is generally classified into P-N junction, Schottky junction, and hetero junction. It is well known that a large amount of heat evolves at the junction when a voltage is placed across the potential barrier and is unfavorable in applications such as the Gunn oscillation of super high frequency. In this invention, this heat evolved is utilized as a heat source of the thermal print head thereby achieving the above-stated objects and other objects to be understood from the explanation to be subsequently described.

For a clearer understanding of the nature and objects of this invention, reference may be had to the following detailed description taken in connection with the accompanying drawings.

DESCRIPTION OF THE DRAWINGS

It will be noted that, throughout those drawings, like reference numerals designate like or corresponding parts.

DESCRIPTION OF THE PREFERRED EMBODIMENT

Figure 1:
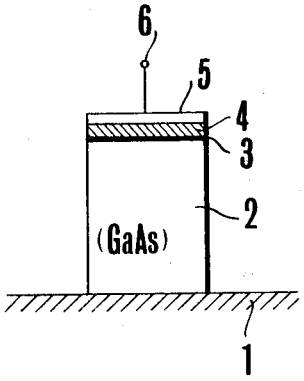
FIG. 1 is a schematic diagram to explain the principle of this invention.

Referring now to the drawings, FIG. 1 illustrates a principle of the thermal print head of this invention. A conductive substrate 1 has a P-type or N-type semiconductor layer 2 thereover. The semiconductor layer 2 is of a semiconductor material such as gallium arsenide (GaAs), gallium phosphide (GaP), mixture of gallium arsenide and gallium phosphide (GaAsP), silicon (Si), etc. A non-epitaxial layer of gallium arsenide (GaAs) may be employed for the layer 2 when the thermal point head is activated by applying an inverse voltage across the junctions of heat elements therein. A metal layer 4 of platinum is formed on the semiconductor layer 2. It will be noted that the metal layer 4 may be composed of any material which is capable of forming a potential barrier at the contact portion with the semiconductor layer 2. In this case, the potential barrier is formed at the junction 3 between the platinum metal layer 4 and the semiconductor layer 2. An electrode 5 is fabricated over the metal layer 4 with ohmic contact therebetween. A lead wire 6 is connected to the electrode 5 and leads the heating elements to the surrounding circuit.

This example is of the Schottky junction type which is composed of platinum and gallium arsenide (GaAs). It should be understood, however, that this instance is employed for clarity and illustration purposes only, and other types of junction may be applicable for this invention. The platinum layer is durable under high temperature of 600°C to 700°C. Gallium arsenide (GaAs) may keep its semiconductor functions even under 400°C to 500°C. Thus it can be seen that the junction in this case is improved in the temperature stability compared to the conventional device of this kind.

There are two ways to generate heat at the Schottky junction; one way is to apply an inverse voltage across the junction, and other way is to place a voltage in the forward direction across it. However, in this type of diode construction, it is preferable to employ the former way, i.e., to apply an inverse voltage across the junction, because a high efficiency of heat generation is obtained due to a barrier. Further it is to be noted that heat capacity of this type of heat source is quite small compared with the prior art, since heat generation occurs at the boundary between two materials. Thus, a considerably large amount of heat per unit volume is obtained so that a thermal print head of high temperature can be easily made. Accordingly, power consumption is reduced in the thermal print head using this heat source as a heating element. The heating elements of this invention may be disposed more closely to the printing paper than that of the prior art utilising a semiconductor resistor. This further facilitates the reduction of power consumption. According to the thermal print head of this invention, one half the power consumption compared to that of the prior art is required to print.

Figure 2:
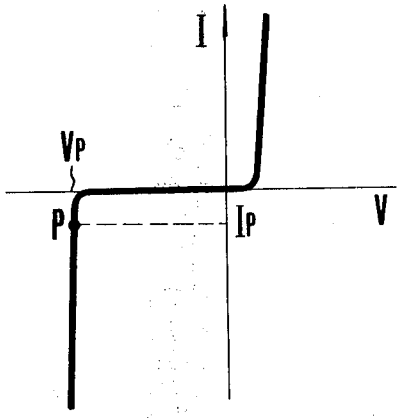
FIG. 2 shows the current versus the voltage characteristic curve of the device illustrated in FIG. 1.

FIG. 2 shows the current versus voltage characteristic curve of the heating element according to this invention. In order to generate heat at the point P on the characteristic curve, two driving circuits are known; one is a constant current driving circuit and other is a constant voltage driving circuit which may be formed by employing resistance increased by varying the distribution of impurity diffusion density. The former driving circuit is superior to the latter in heat generation. When a plurality of heating elements are simultaneously heated, the constant current driving circuit designed so as to drive the corresponding number of the heating elements, may be employed.

Figure 3A:
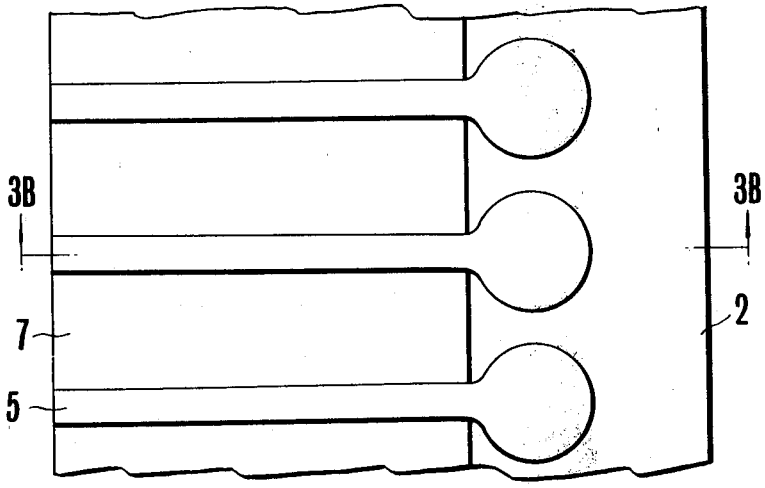
FIG. 3A is a fragmentary plan view of the thermal print head of Schottky junction type according to this invention.
Figure 3B:
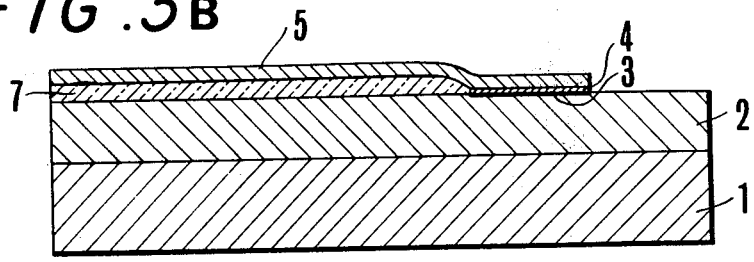
FIG. 3B is a cross sectional view taken along the line 3B — 3B in FIG. 3B.
Figure 4A:
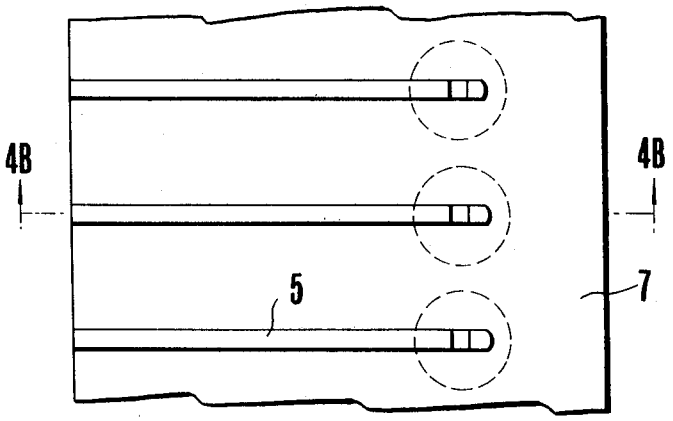
FIG. 4A is a plan fragmentary of the thermal print head of P-N junction type according to this invention.
Figure 4B:
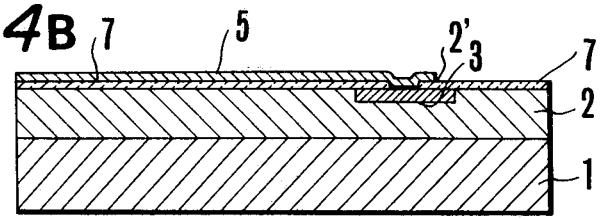
FIG. 4B is a cross sectional view taken on the line 4B — 4B in FIG. 4A.

Next, the thermal print head of Schottky type utilizing a titanium layer in lieu of a platinumn layer will be described with reference to FIG. 3A and FIG. 3B. The substrate 1 is composed of metal such as aluminium, semiconductor, or ceramic and glass the surfaces of which are processed with conductive coating. The thickness of the semiconductor wafer 2 of gallium arsenide (GaAs) is 200 $\mu$m, the semiconductor wafer being mounted on the substrate by means of proper adhesive. The metal layer 4 of titanium is vapor-deposited to the thickness of 1500A over the semiconductor wafer 2 to form a potential barrier therebetween. Reference numeral 3 represents the junction forming a potential barrier. A lead wire 5 of gold (Au) is vapor-deposited to the thickness of 7000A. An electrical insulating layer 7 functions to electrically isolate the semiconductor wafer 2 from the lead wire 5, and is sputtered to the thickness of 4000A with silicon dioxide ($SiO_2$). The junction 3 is formed by etching process into 100 $\mu m\phi$ in diameter. The breakdown voltage, when the inverse voltage is applied between the semiconductor 2 and the lead wire 5, is determined by the impurity density diffused in the semiconductor. For example, the breakdown voltage was 72 V when impurity density is $10^{16}/cm^3$ with gallium arsenide (GaAs) as the semiconductor layer and titanium (Ti) as the metal layer. A good response was observed on the conventional thermosensitive paper when this thermal print head is activated for 10 miliseconds (ms) with current of 30 to 100 mA. A similar good response also was observed when tungsten instead of titanium is used as a metal layer. In FIGS. 4A and 4B there is illustrated the structure of a thermal print head using the P-N junction as a non-linear barrier resistor. The heating element of junction is formed between P-type semiconductor layer 2′ and N-type semiconductor layer 2. Needless to say that when the reference numeral 2′ represents N-type semiconductor, the reference numeral 2 designates P-type semiconductor. Since the diffusion technique is employed in the P-N junction, good junction is obtained in the contact surfaces. In addition, a high heat resistance is obtained in the structure because the heat expansion coefficient is the same in both the semiconductor materials. A satisfactory result was observed in the printing operation on the thermosensitive paper when an inverse current of 200 mA is supplied to the Zenner diode (of which breakdown voltage is 10 volts) utilizing the breakdown on the silicon diode's characteristic in the inverse direction.

Figure 5A:
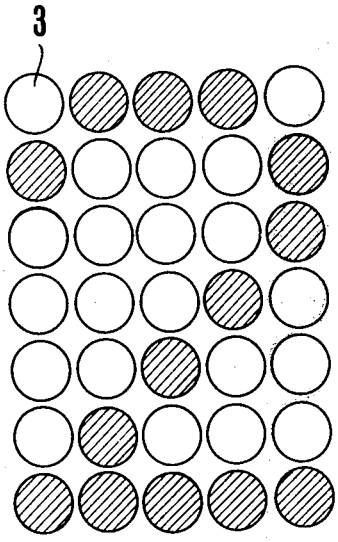
FIG. 5A is a plan view a matrix using one type of the heat elements according to this invention.
Figure 5B:
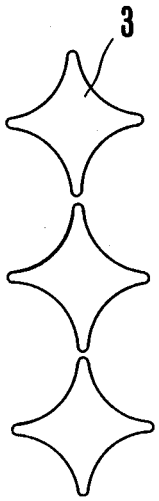
FIG. 5B is a plan view of another type of the heat elements according to this invention.

It should be noted that the junctions 3 of the embodiments of FIG. 3 and FIG. 4 are formed to be circles in configuration by etching. In a junction type heating element of this invention, a current flows through the junction in the right angle direction to the junction surface. For this reason, any type of configuration may be formed, although that of the prior art was restricted to be rectangular. FIG. 5A shows a plan view of the junction type of heating elements of circle configuration in which some of the heating elements form a numeral 2 (shaded with oblique lines). In FIG. 5B, there is illustrated an arrangement of an asteroid shaped heat elements by which an oblique line in the pattern to be printed is improved in visual quality.

Figure 6:
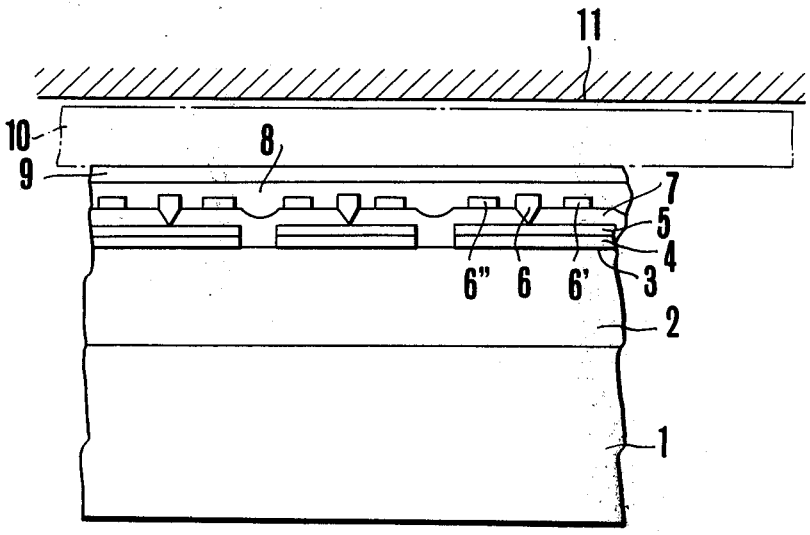
FIGS. 6 through 9 show cross sectional views of the various preferred embodiments of the thermal print head of this invention.

In FIG. 6, there is shown a preferred embodiment of the thermal print head using a plurality of junction type heating elements in accordance with this invention. A substrate 1 is composed of a metal such as copper, aluminum, semiconductor, or glass and ceramic the surface of which are processed by conductive coating. The substrate 1 also serves as a heat radiator. A semiconductor layer 2 is grown on the substrate by expitaxial method. The semiconductor may be of P-type or N-type and composed of such material as gallium arsenide. The metal layer 4 may be composed of the material such as platinum to form a potential barrier with the semiconductor layer 2 at the junction therebetween. The reference number 3 represents a junction which is to be a heating element. An electrode layer may be a material such as gold and fabricated over the metal layer 4 with the desired pattern as an individual dot by etching techniques, etc. A reference numeral 6 represents a lead wire which is led to the terminal of the thermal print head by means of the conductive wire 6 and 6′ connected to other heating elements. An insulating layer 7 functions to electrically isolate the electrode 5 from the conductive wires 6 and 6′, and to protect the semiconductor layer 2. The insulating layer 7 may be formed of material such as silicon oxide by the sputtering technique. A layer 8 of silicon dioxide may be sputtered to prevent the lead and conductive wires 6, 6′ and 6″ from shorting each other. A wear protective layer 9 composed of material such as tantalum oxide ($Ta_2O_5$) is sputtered over the layer 8 to prevent the thermal print head from wearing caused when the thermosensitive paper slides on the head. Any conventional thermosensitive paper 10 may be used and is supported by means of the platen 11.

In this embodiment, as apparent from the drawing, the platinum layer 4 and the electrode layer 5 are fabricated on the N-type semiconductor layer 2 into the desired configuration of individual dots by the etching technique, the N-type semiconductor fabricated over the substrate 1 by the epitaxial growth being common to those heating elements specified by the platinum 4 and the electrode 5, respectively. Accordingly, many advantages result from such unique structure as follows:

1. A fabrication process is extremely simplified;
2. Considerably high reliability of the connections is obtained between the substrate 1 and the N-type semiconductor layer 2, and between the electrode layer 5 and the platinum layer 4;
3. The conductivity of the electrode 5 eliminates limitation in forming the electrode so as to enhance dimensional precision for avoidance of heat concentration and for securing the desired resistance value.
4. Electrical power is effectively utilized due to the fact that the thermal print head may be disposed more closely to the thermosensitive paper than the prior art semiconductor head of mesa type (for example, the span of about 2 to 3 $\mu$m between the heating element and the head surface could be attained while the span between the heating element and the head surface is about 20 $\mu$m in the prior art).
5. Degradation of the conductive wires is avoided due to an increased driving voltage, i.e., a driving voltage of 10 to 100 V according to this invention may be utilized in this invention while in the prior art the driving voltage is only 10 V at most.

Figure 7:
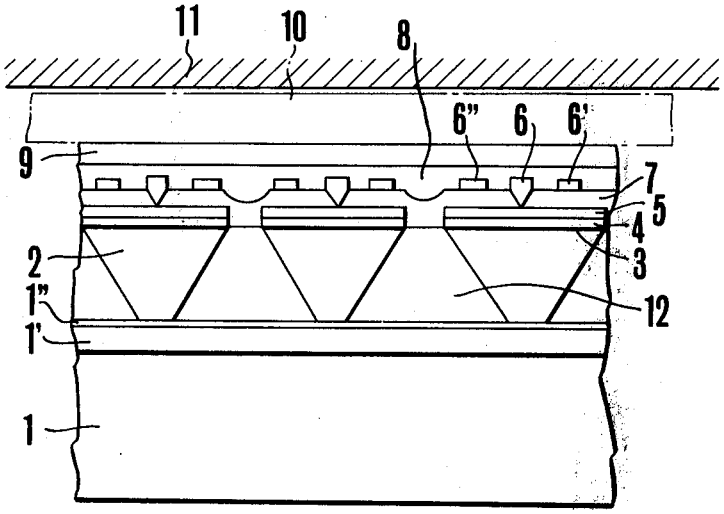

Another preferred embodiment of this invention is illustrated in FIG. 7. In the drawing, reference numeral 1′ designates a thermal insulating but conductive layer being formed by a thick cermet film, for example. A conductive layer 1″ is formed by plating of gold (Au), and has an ohmic contact with a semiconductor 2. An electrically conductive but thermal insulating layer of a thick cermet film and an electrode layer of gold plating coated over a thick cermet film are provided between substrate member and semiconductor member. A thick cermet layer is made to contact with the substrate member. An insulating layer 12 thermally isolates semiconductor layers 2 from each other, and further semiconductor member is partitioned into a plurality of section being positioned corresponding to metal layer with the desired pattern as an individual dot and electrodes member, and may be openings formed by etching techniques or any thermally insulating material stuffed in the openings.

According to this embodiment, an additional advantage to those of the embodiment of FIG. 6 is obtained in that thermal isolation is enhanced among the heating elements, thus eliminating blur in the printed pattern with the result of excellent printing quality.

Figure 8:
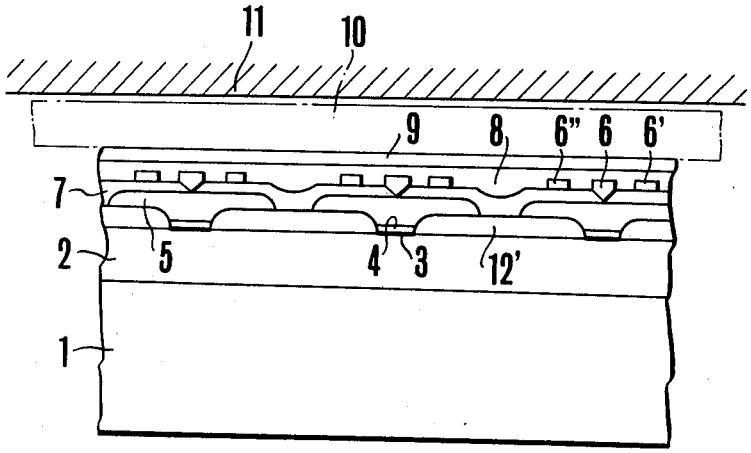

In FIG. 8, there is shown a preferred embodiment of a thermal print head using non-linear barrier resistors as heating elements, featured in that thermal isolation is improved among the heating elements, and the fabrication process also is improved. The thermal isolating layer 12′ composed of material such as silicon oxide is formed by sputtering process. In the operation of this device, a voltage is selectively applied between the electrical conductor 6 and the semiconductor layer 2 according to the desired pattern to be printed wherein a current for generating heat flows through the electrode 5 of ohmic contact, the metal layer 4, the junction 3 and the semiconductor 2. The heat generated at the junction 3 instantaneously diffuses through the metal layer 4 and the ohmic contact electrode 5 thereafter conducting to the thermosensitive paper 10 via the insulating layer 7, the layer 8, and wear protective layer 9. The area of an individual dot is equal to the contact surface between the thermosensitive paper 10 and the ohmic contact electrode 5 which serves to enlarge the heat conductive area.

In this embodiment, the junctions 3, the ohmic contact electrodes, and the thermally insulating layer 12' are uniquely designed to secure a high degree of thermal insulation among the individual dots or the heating elements, the metal layers 4 are relatively small area while the thermal insulating layers 12' are relatively large area when the area of those layers are compared.

The junction 3 is made such that the area is made small so as to increase the thermal diffusion resistance to the semiconductor layer 2 to effect sufficient thermal isolation among the individual heating elements. The electrode 5 also functions to enlarge the thermal conductive area. For this function, it is composed of thermal conductive material such as gold (Au) and is increased in the thickness thereof to reduce the thermal diffusion resistance thereof. The thermal insulating layer 12' is formed of material of low thermal conductivity such as silicon dioxide ($SiO_2$), which is thick.

For example, the thermal diffusion resistance of the junction is approximately 270°C/watt with the area of the junction of 50 $\mu m\phi$. The electrode 5 has about 100°C/watt in the thermal resistance when the thickness thereof is 10 $\mu$m. When the thickness of the thermal insulating layer 12' is 50 $\mu$m, the thermal resistance is about 400°C/watt. This shows that sufficient thermal isolation is secured among heating printing elements, and uniformity of temperature in the individual printing element is achieved to effect sharp high printing quality. It may also be seen that there is no need of mesa structure made by etching, etc., and the structure enhances mechanical strength, facilitates and simplifies the fabrication process, and improves the reliability.

Figure 9:
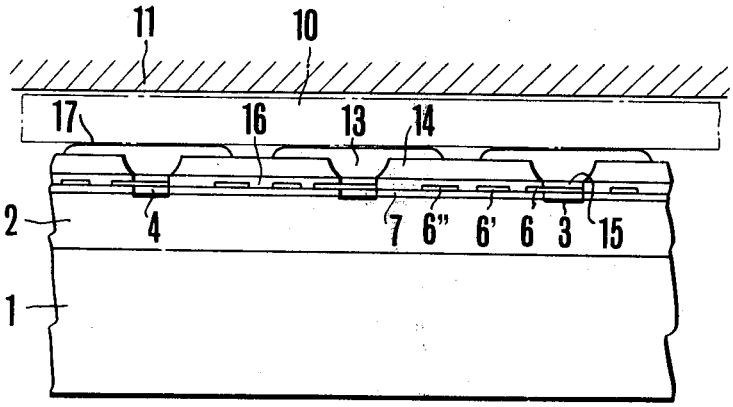

In FIG. 9, there is depicted a modification of the embodiment shown in FIG. 8.

Figure 10:
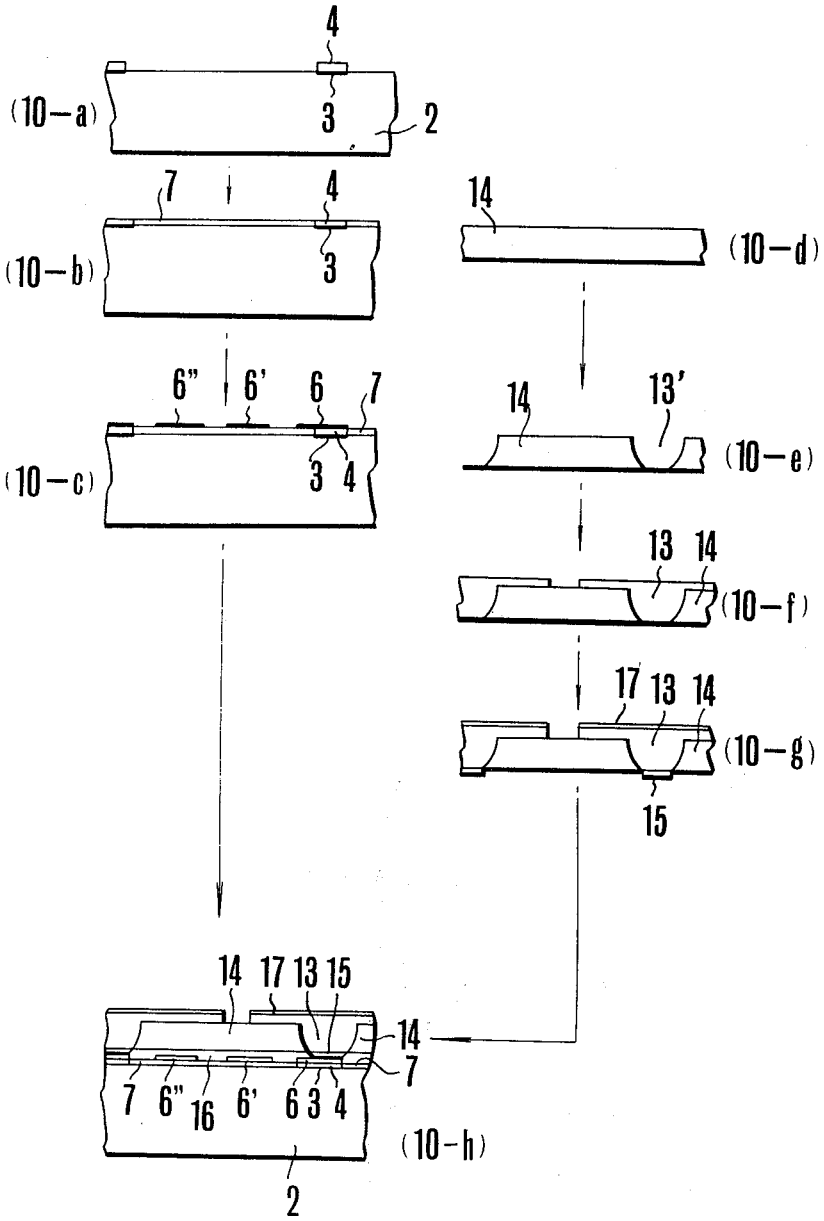
FIG. 10 shows a fabricating process of the thermal print head in FIG. 9.

A metal layer 4 such as platinum is fabricated over a semiconductor layer 2. The junction as a heating element is designated by a reference numeral 3. An electrode 6 is formed upon an insulating layer 7 and a metal layer 4. Electrodes 6', 6'' are formed on the insulating layer 7. A thermal conducting body 13 formed of thermal conductive material, such as gold or copper, is supported by means of a supporting layer 14. The thermal conducting body 13 functions to enlarge the thermal conducting area. The supporting layer 14 is composed of an electrically and thermally insulating material. The reference numeral 15 represents adhesive of solder or gold. Openings 16 are made between the supporting layer 14 and the insulating layer 7. Further detailed structure and features of this embodiment will be fully understood from FIG. 10 illustrating the fabricating process thereof.

A preferred fabricating process of the device shown in FIG. 9 will be described hereinunder with reference to FIG. 10.

A plurality of platinum layers 4 are selectively arranged on the semiconductor layer 2 by vapor deposition in accordance with the arrangement of individual printing dots for printing (10a). Silicon oxide is sputtered to form an insulating layer 7 of 2 $\mu$m in thickness. After sputtering, the insulating layer over the junctions formed between the layer 4 and the semiconductor layer 2, is removed (**10*b*). Lead wires 6 of nickel chromium alloy are vapor deposited over the silicon oxide layer 7 (10*c***).

On the other hands, a supporting member 14 formed of materials such as glass or epoxy resin with thickness of about 50 $\mu$m is prepared (**10*d*). A plurality of throughholes 13' are made by laser or etching techniques at the positions corresponding to the junctions 3 selectively arranged on the semiconductor layer 2, the diameter of the througholes 13' being nearly equal to that of the junction 3 (10*e*). Gold or copper is electroless-plated on the surface of the supporter 14 and in the throughholes 13'. The thickness of the copper or gold layer plated is restricted to 10 to 20 $\mu$m to prevent the increase of thermal resistance. The layer of copper or gold is etched to form the desired pattern of the individual printing elements. The etched layer results in the layer 13 to enlarge the thermal conductive area (10*f*). A wear protective layer 17 is plated over the layer 13 with nickel chromium (NiCr). Adhesive of solder or gold is provided on the lower surface of the layer 13 (10*g***).

As the final step of in the fabrication of the thermal print head, the supporting layer 14 fabricated by the process designated (**10*d*) through (10*g*), is mounted on the semiconduct layer 2 fabricated by the process of (10*a*) through (10*c*) with registered position. Then, those are bonded to each other by the thermocompression or some other bonding way. It is to be noted that any number of the junction 3**, or the heating element per one printing dot will be permitted if thermal diffusion resistor and thermal response which are required on the fabrication of the thermal print head, is secured.

Figure 11:
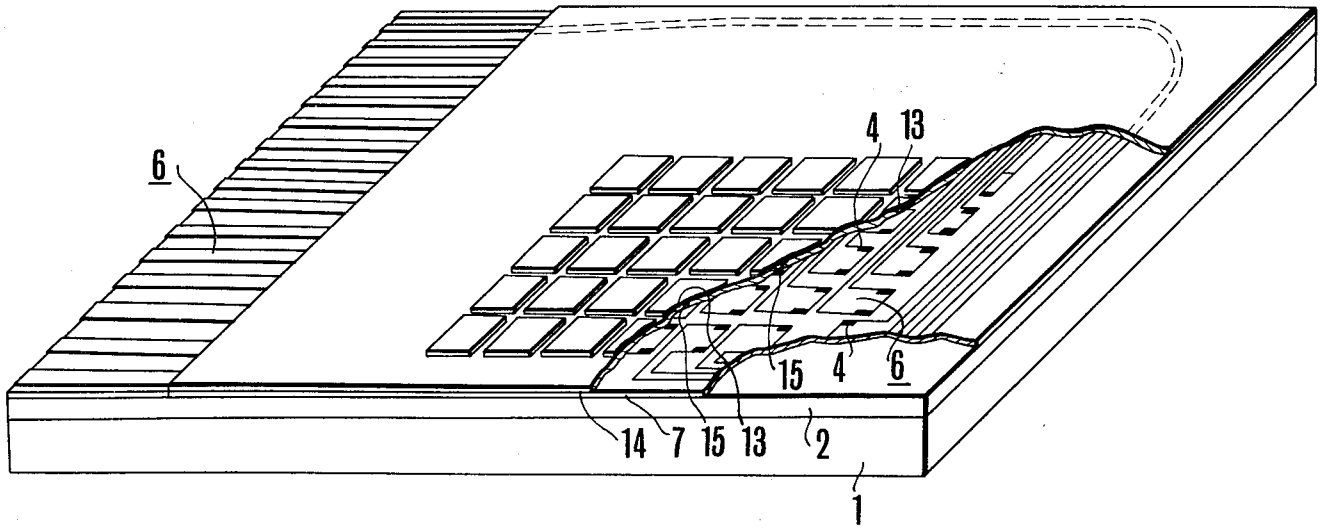
FIG. 11 is a perspective view broken away in part of the thermal print head according to this invention.

FIG. 11 shows a perspective view broken away in part of the thermal print head constructed in accordance with the embodiment of FIG. 9, in which two junctions per one printing dot are employed.

From the above description, it may be seen that this embodiment has many advantages as follows: Improvement is achieved in thermal isolation among heating elements and in uniformity of temperature in a printing element with result of excellent printing quality; Elimination of mesa structure of printing head enhances the mechanical strength, improves the yield by lowering the rate of occurrence of devices of inferior quality in the fabrication, and minimize degradation of the device due to thermal stress; Since the lead wires are positioned under the supporting layer 14, the possibility of disconnection of the lead wires is low due to the fact that they are not subjected to the abrasive action with the thermosensitive paper, and lifetime and reliability of the device also is extremely improved.

Figure 12A:
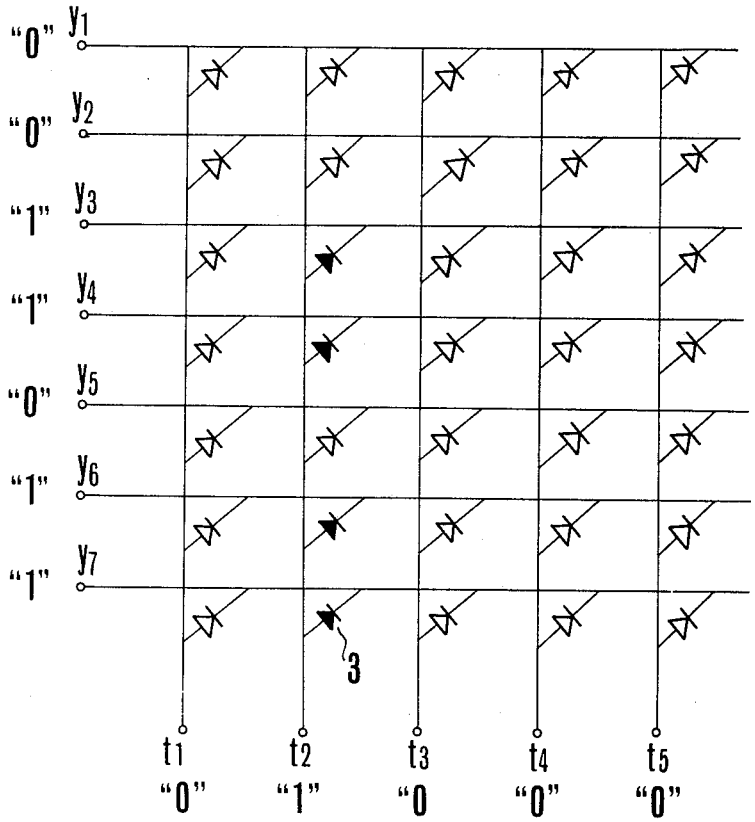
FIG. 12A is a schematic diagram showing an actuating circuit to actuate the thermal print head of this invention.
Figure 12B:
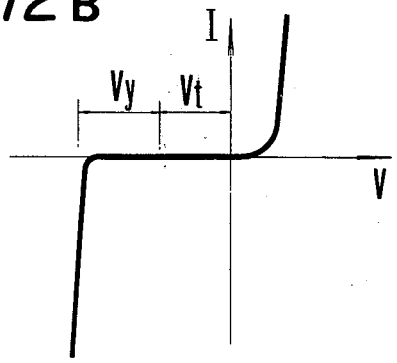
FIG. 12B is a current versus voltage characteristic curve for the heating element of this invention useful to explain the operation of the driving circuit shown in FIG. 12A.

FIG. 12 illustrates an embodiment of the driving circuit to effectively actuate the thermal print head of this invention. It is to be noted that since the heating element of this invention has a diode characteristic as shown in FIG. 2, the diode matrix driving circuit as seen in FIG. 12A, may be constructed without excess diodes.

Figure 12C:
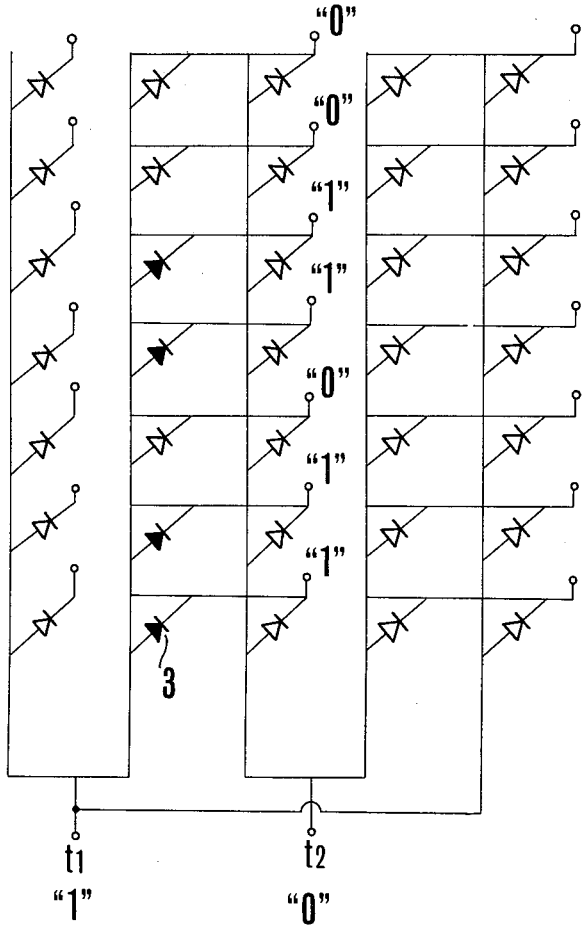
FIG. 12C is a schematic diagram showing another driving circuit to actuate the thermal print head of this invention.

In the operation, when the heating elements marked with black in FIG. 12A are actuated, actuating voltage is applied to the terminals, *y*3, *y*4, *y*6 and *y*7 while at the same time the terminal *t*2 is actuated. According to the device of this invention, the heating element serves as both the heating source and the rectifier so that the number of lead wires required is reduced. In FIG. 12A, there is depicted an acutating circuit of 5 by 7 matrix constructed by twelve lead lines. In the embodiment in FIG. 12A, it is possible to drive the circuit with the potential difference between the terminals Vy and Vt being larger than the breakdown voltage of the diodes as seen FIG. 12B. FIG. 12C illustrates another embodiment of the driving circuit of the thermal print head according to this invention, by which the time to activate the device may be reduced. According to this circuit, only two times for the terminals $t_1$ and $t_2$, for example, is required to actuate, by comparison with five times for the terminals $t_1$, $t_z$, $t_3$, $t_4$ and $t_5$ of the circuit of FIG. 12A.

The operational point of the thermal print head of this invention is on the point P shown in FIG. 2. It is desirable to employ the constant current drive, as in the above, for driving the device at this point. However, it is preferable to use the driving circuit of a constant voltage when in practical use.

If it is desirable to speed up printing operation in the embodiments supra, it may be satisfied by using heating elements being alloyed or diffused with the alloy composited of bismuth, tellurium, and iodine. The reason for this is that it is possible to cool the heating elements by Peltier effects if forward voltage is applied to the heating elements after inverse voltage is placed to it for printing. Accordingly, the thermal print head may be made compact and printing speed of it may be improved.

The foregoing examples are offered as exemplary of the multitude of possible device designs which depend upon the basic teachings of this invention and are not to be constructed as limiting the invention. Various other modifications and embodiments will become apparent to those skilled in the art. However, all such devices are properly considered within the spirit and scope of this invention.

What is claimed is:

1. A thermal print head circuit provided with a plurality of heat sources capable of converting electrical energy into heat energy for printing on a thermosensitive medium with the heat energy converted comprising:
   - a multilayer device including a substrate member, a first member formed over said substrate member, and a plurality of second members arranged on said first member forming a potential barrier at the junctions between said first member and said second members thereon; and
   - potential applying means for applying an inverse voltage across said potential barrier for generating heat at said junction as the sole source of said heat energy for printing.

2. A thermal print head circuit as claimed in claim 1, in which said junctions are arranged in a matrix and including conductors forming the rows and the columns of said matrix directly connected respectively to opposite sides of said junctions and operable to be energized to select the desired junction.

3. A thermal print head provided with a plurality of heat sources capable of converting electrical energy into heat energy for printing on a thermosensitive medium with the heat energy converted comprising:
   - a substrate;
   - a first member formed on said substrate;
   - a plurality of second members formed on said first member with a potential barrier junction therebetween;
   - a plurality of electrode means ohmically formed, one on each of said second members;
   - insulating means to protect and electrically insulate said first member and said electrode means;
   - electrically conductive means connected to each of said electrode means to form a circuit for energizing said junction as the sole source of said heat for printing;
   - a short preventing member of insulating material to prevent short circuiting among said electrically conductive means;
   - wherein said first member and said second members forming said potential barriers at the junctions therebetween have said second members arranged corresponding to individual dots for printing information.

4. A thermal print head as claimed in claim 3, wherein said substrate is composed of material selected from the group of metal material of copper or aluminium, semiconductor material, insulating material of glass or ceramic, the surface of which is coated with conductive layer, and thick cermet material.

5. A thermal print head as claimed in elaim 3, wherein said first member and said second members are composed of semiconductor of P-N junction.

6. A thermal print head as claimed in claim 3, wherein said first member and said second members are composed of semiconductor of hetero junction.

7. A thermal print head as claimed in claim 3, wherein said first member and said second member are composed one of metal and the other of semiconductor.

8. A thermal print head as claimed in claim 5, wherein said semiconductor material is selected from the group consisting of silicon (Si), gallium arsenide (GaAs), gallium phosphide (GaP), and mixture of gallium arsenide and gallium phosphide (GaAsP).

9. A thermal print head as claimed in claim 7, wherein said semiconductor material is selected from the group consisting of silicon (Si), gallium arsenide (GaAs), gallium phosphide (GaP), and mixture of gallium arsenide and gallium phosphide (GaAsP), while said metal material is selected from the group consisting of platinum (Pt), tungsten (W), and titanium (Ti).

10. A thermal print head provided with a plurality of heat sources capable of converting electrical energy into heat energy for printing on a thermosensitive medium with the heat energy converted comprising:
   - a conductive substrate;
   - a wafer of gallium arsenide (GaAs) fabricated on said conductive substrate;
   - a plurality of platinum areas fabricated over said wafer each forming a junction, which are arranged corresponding to the arrangement of printing elements for printing information;
   - gold electrodes formed on each said platinum layer;
   - electric conductors connected to each of said electrodes to form a circuit for energizing said junction as the sole source of said heat for said printing;
   - an insulating layer of silicon dioxide ($SiO_2$) located between said electrodes and said wafer;
   - a short preventing layer over said electrodes to prevent short-circuiting of said electrodes;
   - a wear protective layer of tantalum oxide ($Ta_2O_5$) to prevent abrasive wear covering said short preventing layer;
   - wherein when an inverse current is made to flow through the junction formed between said platinum layers and said gallium arsenide wafer, said junctions function as heat elements.

11. A thermal print head provided with a plurality of sources capable of converting electrical energy into heat energy for printing on a thermosensitive medium with the heat energy converted comprising;

a conductive substrate member;

a first member formed over said substrate member;

a plurality of second members each ohmically formed on said first members;

a plurality of electrodes formed on each of said second members;

an insulating member between said first member and said second members;

an electrically conductive means connected to each said electrode;

a short preventing member over said electrodes to prevent short-circuiting of said electrically conductive means;

wherein said first member and said second members form potential barriers at the junction formed therebetween as the sole source of said heat for printing, said second members are arranged on the said first member corresponding to the arrangement of individual printing elements for printing information, and further said first member is partitioned into a plurality of sections positioned corresponding to said second members and said electrodes members, and a thermally insulating material on said first member.

12. A thermal print head as claimed in claim 11, wherein an electrically conductive but thermally insulating layer and an electrode layer coated over said layer are provided between said substrate member and said first member, said former layer being made to contact with said substrate member.

13. A thermal print head provided with heat source capable of converting electrical energy into heat energy for printing on a thermosensitive medium with the heat energy converted comprising;

a conductive substrate member;

a semiconductor layer fabricated over substrate member;

a plurality of metal areas formed over said semiconductor layer;

a thermally insulating layer arranged between adjoining metal areas;

electrode layers formed over each of said metal areas;

electrically conductive wires formed on said electrode layers connected with said electrode layers;

an insulating layer positioned to protect and electrically isolate said electrode layers and said wires;

a short preventing layer to prevent short-circuiting of said wires;

wherein said semiconductor layer and said metal layer form potential barriers at the junctions formed therebetween as the sole source of said heat for printing, said metal layers are arranged in accordance with the arrangement of individual printing elements, said metal layers are of relatively small area while said thermally insulating layers are of relatively large area.

14. A thermal print head being provided with heat source capable of converting electrical energy into heat energy, which prints on the thermosensitive medium with the heat energy converted comprising of;

a conductive substrate;

a semiconductor layer;

a plurality of metal layers formed on said semiconductor layer with such an arrangement as the individual printing elements;

insulating layers coated over each of said metal layers;

electrode layers formed on each of said metal layers thermally and electrically insulating members bridging between adjoining electrode layers;

electrically conductive members which are disposed in the void spaces formed by said insulating layer and said thermally and electrically insulating layers;

a member to enlarge a thermal conductive area, which is formed on the said metal layers.

15. A thermal print head as claimed in claim 14, wherein an insulating material is filled in said void spaces.

16. A thermal matrix print head comprising a row and column array of conductors for energizing the selected points in said matrix and a threshold isolation junction connected between the row and column conductors at each of said points, said threshold isolation junction being the sole source of heat for printing at said selected points when energized in the reverse direction beyond threshold.

* * * * *

UNITED STATES PATENT AND TRADEMARK OFFICE

CERTIFICATE OF CORRECTION

PATENT NO. : 3,931,492

DATED : January 6, 1976

INVENTOR(S) : Rikuo Takano, Mitsushi Matsunaga, Akira Yoshida, Kiyoshi Nawata and Shigehisa Nakaya It is certified that error appears in the above-identified patent and that said Letters Patent are hereby corrected as shown below:

Column 1, line 23, delete "Those advantages of this";
line 24, delete "printer has attracted a significant attention" and substitute therefor -- advantages which have attracted significant attention.--;
line 27, "head" should be -- heads --;
line 28, before "provided" insert -- which --;
line 34, "cement" should be -- cermet --;
line 41, before "matrix" insert -- a --;
Column 3, line 3, after "fragmentary" insert -- view --;
line 7, after "view" insert -- of --;
line 43, change "point" to -- print --;
Column 4, line 65, a new paragraph should begin with the word "In";
line 68, before "junction" insert -- the --;
Column 5, line 44, after "layer" insert -- 5 --;
line 60, change "wearing" to -- weariness --;
Column 6, line 12, change "limitation" to -- limitations --;
Column 8, line 28, delete "some";
Column 11, line 2, before "sources" insert -- heat --.

Signed and Sealed this

First Day of November 1977

[SEAL]

Attest:

RUTH C. MASON
Attesting Officer

LUTRELLE F. PARKER
Acting Commissioner of Patents and Trademarks